United States Patent [19]

Kness

[11] 4,434,553

[45] Mar. 6, 1984

[54] DRY-SHAVING APPARATUS HAVING A TRIMMER

[75] Inventor: Werner Kness, Klagenfurt, Austria

[73] Assignee: U.S. Philips Corporation, New York, N.Y.

[21] Appl. No.: 369,872

[22] Filed: Apr. 19, 1982

[30] Foreign Application Priority Data

May 5, 1981 [AT] Austria ..... 1983-81

[51] Int. Cl.[3] ..... B26B 19/38

[52] U.S. Cl. ..... 30/34.1; 30/90; 30/162

[58] Field of Search ..... 30/34.1, 90, 162–163, 30/43.1

[56] References Cited

U.S. PATENT DOCUMENTS

| | | | |
|---|---|---|---|
| 3,780,434 | 12/1973 | de Boer et al. | 30/34.1 |
| 3,962,783 | 6/1976 | Reutema | 30/34.1 |
| 4,283,848 | 8/1981 | Messinger et al. | 30/34.1 |

*Primary Examiner*—James M. Meister
*Assistant Examiner*—Douglas D. Watts
*Attorney, Agent, or Firm*—Rolf E. Schneider

[57] ABSTRACT

There is provided a dry-shaving apparatus comprising a housing section having an opening formed therein. A trimmer constructed as a flat unit is arranged on the housing section so as to be slidable between at least two positions, the trimmer unit being mounted in the opening. Two lateral guide portions are formed on the trimmer unit and extend parallel to each other and to the sliding direction of the trimmer unit. Guides are formed on the housing section and respectively co-operate with the guide portions, the guides, viewed in the sliding direction, being arranged near one end of the opening. A bridge is arranged near the other end of the opening and extends across such opening transversely of the sliding direction, the bridge engaging the trimmer unit from the inside of the housing section. A resilient strip extends from the trimmer unit in the sliding direction and projects into the interior of the housing section towards the bridge, the normal distance, measured in the sliding direction, between the free end of the strip and those ends of the guide portions remote from such free end of the strip being greater than the clearance between the bridge and those ends of the guides facing the bridge.

3 Claims, 12 Drawing Figures

DRY-SHAVING APPARATUS HAVING A TRIMMER

BACKGROUND OF THE INVENTION

This invention relates to a dry-shaving apparatus having a trimmer constructed as a flat unit and arranged on a housing section of the dry-shaving apparatus so as to be slidable between at least two positions, the trimmer unit being mounted in an opening formed in the housing section and having two lateral guide portions which extend parallel to each other and to the sliding direction, which guide portions each co-operate with a corresponding guide formed on the housing section.

Such a dry-shaving apparatus, which is for example known from U.S. Pat. No. 4,283,848, requires the use of means which ensures that the trimmer unit which is mounted on the housing section cannot inadvertently be detached from the housing section. For this purpose the guide portions on the trimmer unit and the corresponding guides on the housing section are generally constructed so that during assembly the guide portions of the trimmer unit can be fitted into the guides on the housing section, after which the guides are provided with covering or locking members in such a way that the guide portions on the trimmer unit can not leave the guides on the housing section. These covering or locking members may be connected to the housing section so as to be detachable, for example by means of screws, or so as to be inseparable, for example in the case of plastic parts by means of a weld. A detachable connection has the disadvantage that it is more intricate and more expensive in production than a non-detachable connection, which in its turn has the disadvantage that the trimmer unit cannot be removed from the housing section when necessary, for example in the case of a repair.

SUMMARY OF THE INVENTION

It is the object of the present invention to provide such a mounting facility for the trimmer unit in a dry-shaving apparatus of the indicated type that said trimmer unit is reliably attached to a housing section of the dry shaving apparatus without additional means but if necessary can readily be detached from the housing section without additional means.

According to the invention this object is achieved in that, viewed in the sliding direction, the guides on the housing section are arranged near one end of the opening, and a bridge is arranged near the other end of the opening, which bridge extends across said opening transversely of the sliding direction and which engages with the trimmer unit from the inside of the housing section, and in that the trimmer unit includes at least one resilient strip which extends in the sliding direction and which projects into the interior of the housing section towards the bridge, the normal distance, measured in the sliding direction between the free end of the strip and those ends of the guide portions on the trimmer unit which are remote from said free end of the strip being greater than the clearance between the bridge and those ends of the guides on the housing section which face said bridge.

In this way the resilient strip in conjunction with the bridge prevents the trimmer unit from being inadvertently detached from the housing section after the guide portions on the trimmer unit have been inserted into the guides on the housing section, because when the strip abuts the bridge the movement of the trimmer unit is limited so that its guide portions cannot leave the guides on the housing section. On the other hand, mounting the trimmer unit in the housing section is very simple. For this purpose, after it has been inserted into the opening, the trimmer unit is tilted and pressed against the bridge with the strip until this strip is depressed so far that the guide portions of the trimmer unit can be inserted into the guides on the housing section, the strip being no longer retained by the bridge and being released as the trimmer unit is further inserted, so that the housing section and the trimmer unit are already attached to each other in a reliable manner. As can be seen, this arrangement requires no further aids, so that simple and economical mass production is possible. Intentional removal of the trimmer unit from the housing section is equally simple, because to do so it suffices to depress the strip in order to enable it to clear the bridge and subsequently to slide the guide portions of the trimmer unit out of the guides on the housing section, which also requires no additional aids.

For the construction of the guide portions on the trimmer unit and the guides on the housing section there are various possibilities, such as for example grooves on the trimmer unit and ridges on the housing section. However, for a simple construction it is found to be advantageous if the guide portions on the trimmer unit comprise projecting ridges, which extend adjacent the opening along the inner wall of the housing section, and the guides on the housing section comprise hook-shaped projections which project from said housing section and which engage the ridges from the inside of the housing section.

In this respect it is also found to be advantageous if the bridge comprises lateral basic portions which extend adjacent the opening up the inner wall of the housing section, and the clearance between the bridge and those ends of the guides on the housing section which face said bridge is greater than the length of the ridges constituting the guide portions on the trimmer unit. In this way mounting the trimmer unit on the housing section is very easy and simple, because when the trimmer unit is fitted into the opening the basic portions of the bridge which extend adjacent the opening act as stops for those ends of the ridges which face the free end of the strip, about which the trimmer unit is then simply tilted towards the bridge and, after the strip has been depressed, the guide portions of the trimmer unit can simply be slid into the guides on the housing section.

BRIEF DESCRIPTION OF THE DRAWINGS

The invention will now be described in more detail with reference to the accompanying drawings, in which.

DESCRIPTION OF THE PREFERRED EMBODIMENTS

Figure 1:
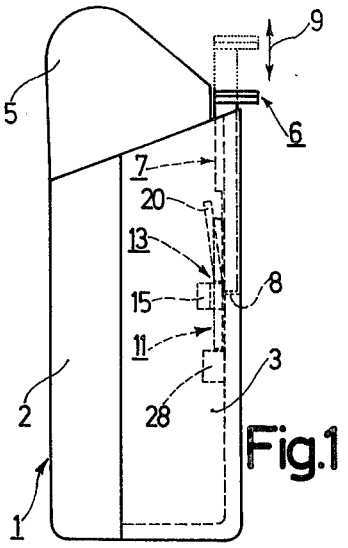
FIG. 1 is a view of a narrow side of a dry-shaving apparatus having a trimmer.
Figure 2:
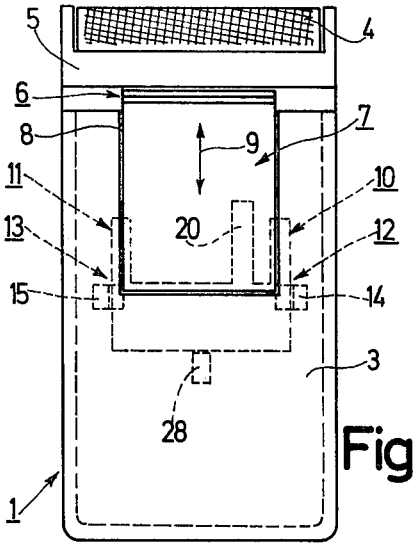
FIG. 2 is a view of a broad side of the dry-shaving apparatus shown in FIG. 1.
Figure 4:
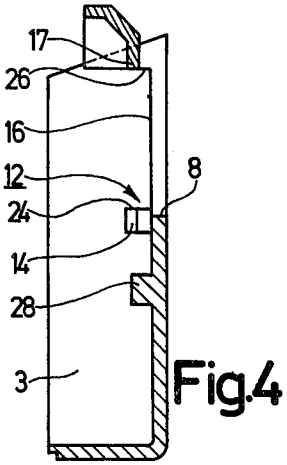
FIG. 4 shows the housing section in a sectional view taken on the line IV—IV in FIG. 3.
Figure 3:
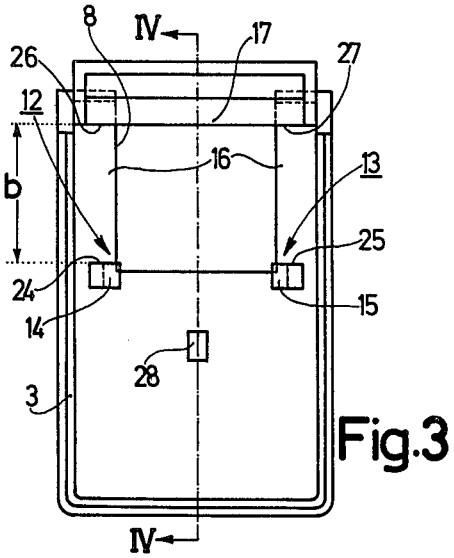
FIG. 3 is an elevational view of the inner side of that housing section of the dry-shaving apparatus which carries the trimmer.
Figure 6:
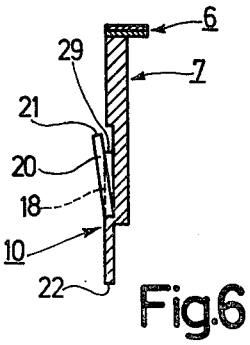
FIG. 6 shows the trimmer in a sectional view taken on the line VI—VI in FIG. 5.
Figure 5:
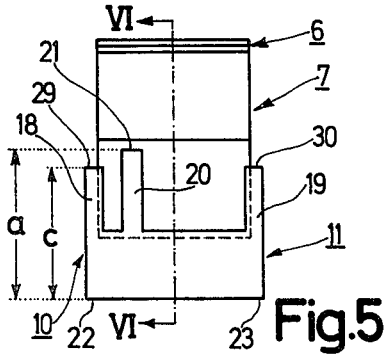
FIG. 5 is a diagramatic elevational view of the trimmer.

In FIGS. 1 and 2 a dry-shaving apparatus 1 comprises two housing sections 2 and 3, on which a shaving head 5 comprising an arcuate shear foil 4 is mounted. This shear foil 4 co-operates in the customary manner with a cutter which can be reciprocated by a motor accommodated in the housing sections. These parts are not shown, because they are irrelevant to the present invention.

The dry-shaving apparatus 1 further includes a trimmer, whose cutter is designated 6 and which is constructed as a flat unit 7, which is arranged on the housing section 3 so as to be slidable between two positions. FIGS. 1 and 2 show the unit 7 in its slid-in position in the housing section 3. The position in which the unit 7 extends from the housing section 3 is also represented by the dotted lines in FIG. 1. For the sake of simplicity the construction of the trimmer, which normally comprises a stationary toothed cutter which co-operates with a toothed complementary cutter which can be reciprocated by the motor of the dry-shaving apparatus, is not shown.

As is shown in FIGS. 1 and 2 the unit 7 is mounted in an opening 8 formed in the housing section 3 and in this opening it can be slid between the two positions in the sliding direction represented by double arrow 9. For this purpose the unit has two lateral guide portions 10 and 11 which extend parallel to each other and to the sliding direction 9, which guide portions each co-operate with a corresponding guide, 12 and 13, on the housing section 3.

Since such dry-shavers are usually manufactured by mass production it is important that the trimmer unit 7 can be mounted on the housing section 3 in a particularly simple and time-saving manner. However, care must be taken that the unit cannot inadvertently be detached from the housing section, but that when necessary the two parts can be separated from each other so as to enable a simple replacement of the unit, for example in the case of a repair. Therefore, the unit can be connected to the housing section in a reliable but detachable manner.

The steps taken in order to achieve this will be described with reference to FIGS. 3 to 6. Viewed in the sliding direction 9 the housing section 3 includes hook-shaped projections 14 and 15 near one end of the opening 8, which projections together with the inner wall 16 of the housing section 3 adjacent the opening 8 form the guides 12 and 13 respectively on this housing section. Near the other end of the opening 8 a bridge 17 is arranged, which bridge extends across said opening 8 transversely of the sliding direction 9. The unit 7 includes guide portions 10 and 11 formed by projecting ridges 18 and 19, which when the unit 7 is mounted in the housing section 3 extend adjacent the opening 8 along the inner wall 16 of the housing section 3, the hook-shaped projections 14 and 15 engaging the ridges 18 and 19 from the inside of the housing section.

Furthermore, the unit 7 includes a resilient strip 20 which extends in the sliding direction 9 and which projects into the interior of the housing section towards the bridge 17. The dimensions are such that the normal distance a, measured in the sliding direction 9, between the free end 21 of the strip 20 and those ends 22 and 23 of the guide portions 10 and 11 respectively on the unit 7 which are remote from the free end of the strip is greater than the clearance b between the bridge 17 and those ends 24 and 25 of the guides 12 and 13 respectively on the housing section 3 which face said bridge. As will be explained hereinafter, this ensures that, when mounted on the housing section 3, the unit 7 is connected to the housing section 3 in a reliable but detachable manner by the co-operation of the strip 20 with the bridge 17.

In addition the bridge 17 includes lateral basic portions 26 and 27, which extend along the opening 8 down the inner wall 16 of the housing section 3. The clearance b between the bridge 17 and those ends 24 and 25 of the guides 12 and 13 respectively on the housing section 3 which face said bridge is selected to be greater than the length c of the ridges 18 and 19 which form the guide portions 10 and 11 respectively on the unit 7. Finally, the housing section 3 includes a stop 28, with which the unit 7 abuts when it is in its slid-in position in the housing section 3.

Figure 7:
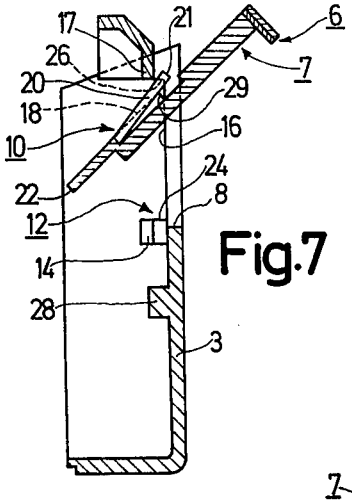
FIG. 7 shows in the same way as FIGS. 4 and 6 how the trimmer is mounted in the opening in the housing section.
Figure 8:
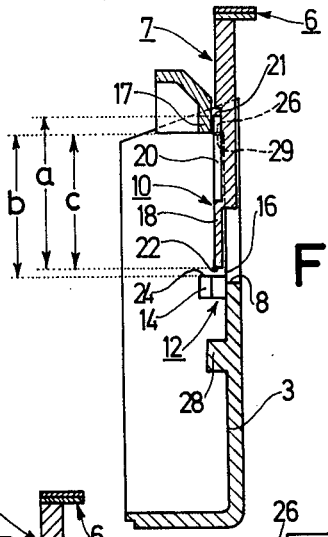
FIG. 8 shows the trimmer in a position in which it has been tilted out of the position of FIG. 7 towards the housing section.

How the unit 7 is mounted on the housing section 3 will now be explained with reference to FIGS. 7 to 10. As can be seen in FIG. 7, the unit 7 is inserted into the opening 8 in the housing section 3 from the inside of this housing section with the trimmer foremost and the strip 20 facing the bridge 17, those ends 29 and 30 respectively of the projecting ridges 18 and 19 which face the cutters 6 of the trimmer engaging with the inner wall 16 of the housing section 3. Subsequently, the unit 7 is slid towards the bridge 17 until the ends 29 and 30 of the projecting ridges 18 and 19 respectively also engage with the basic portions 26 and 27 of the bridge 17, so that pivots are obtained about which the unit 7 can be pivoted counter-clockwise towards the bridge 17 until the projecting resilient strip 20 is depressed. In this position of the unit 7 the other ends 22 and 23 of the projecting ridges 18 and 19 respectively are situated before the guides 12 and 13 on the housing section 3, as is shown in FIG. 8, in which the dimensions a, b and c are also indicated. FIG. 8 shows that, as a result of the presence of the basic portions 26 and 27 of the bridge 17, which portions respectively engage with the ends 29 and 30 of the projecting ridges 18 and 19, it is necessary that the dimension b is greater than the dimension c in order to enable the other ends 22 and 23 of the projecting ridges 18 and 19 to be pivoted before the guides 12 and 13 respectively on the housing section 3. Since these basic portions 26 and 27 constitute stops for the unit 7 during its pivotal movement, this operation is simple and reliable, which is of advantage for the entire assembly process, because such assembly is enabled to be carried out substantially in one manipulation. In principle it is also possible to dispense with such basic portions 26 and 27 of the bridge 17 which extend along the opening 8 down the inner wall 16 of the housing section 3 and to replace them by recesses which are adapted to engage the projecting ridges 18 and 19 respectively during the pivotal movement of the unit 7 towards the bridge 17. In that case the requirement imposed on the dimensions b and c is no longer necessary, because the unit 7 can then be moved so far that the ends 22 and 23 of the projecting ridges 18 and 19 can again be pivoted before the guides 12 and 13 respectively on the housing section 3.

Figure 10:
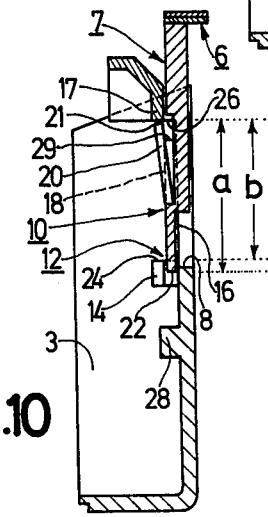
FIG. 10 shows the housing section and trimmer in a sectional view taken on the line X—X in FIG. 9.
Figure 9:
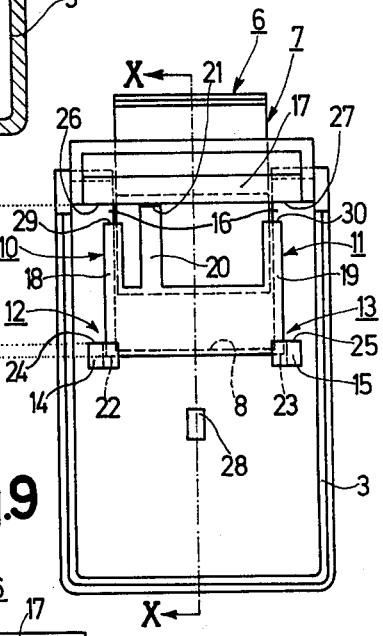
FIG. 9, in an elevational view of the inner side of the housing section, shows the trimmer combined with the housing section, the trimmer being in the position in which it extends from the housing section.

In order to complete the assembly, starting from the position of the unit 7 on the housing section 3 as shown in FIG. 8, it suffices to insert the unit 7 into the housing section 3 past the bridge 17 in the sliding direction 9, whereupon the lateral guide portions 10 and 11 on the unit engage the guides 12 and 13 respectively on the housing section 3. During this movement the unit 7 reaches a position in which the strip 20 on this unit is freed from the bridge 17 and, as a result of its resilience assumes the position in which it projects from the unit 7, in which position its free end 21 is disposed before the bridge 17, as is shown in FIGS. 9 and 10. Once the strip 20 has assumed this position, the unit 7 is reliably attached to the housing section 3, because now the free end 21 of the strip 20 in conjunction with the bridge 17 limits the movement of the unit 7 on the housing section 3. The guide portions 10 and 11 on the unit 7 constituted by the ridges 18 and 19 then can no longer leave the respective guides 12 and 13 on the housing section 3 because, as already stated, the normal distance a, measured in the sliding directing 9, between the free end 21 of the strip 20 and those ends 22 and 23 of the guide portions 10 and 11 respectively on the unit 7 which are remote from said free end 21 of the strip 20 is greater than the clearance b between the bridge 17 and those ends 24 and 25 of the guides 12 and 13 respectively on the housing section 3 which face said bridge, as can be seen in FIGS. 9 and 10. In this way the unit 7 is firmly secured to the housing section 3 and cannot inadvertently be detached therefrom.

Figure 12:
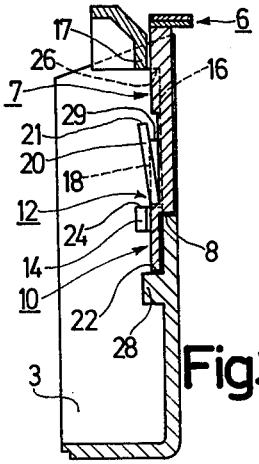
FIG. 12 shows the housing section and the trimmer in a sectional view taken on the line XI1—XII in FIG. 11.
Figure 11:
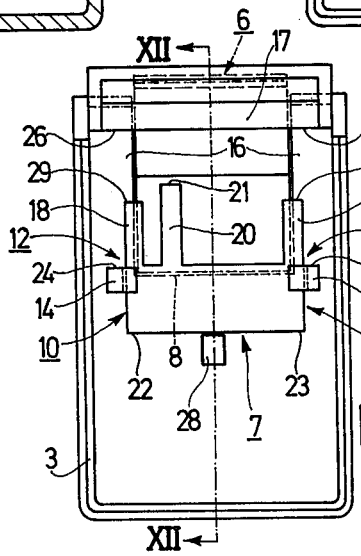
FIG. 11, in the same way as FIG. 9 shows the trimmer in its slid-in position in the housing section.

The abutment of the free end 21 of the strip 20 against the bridge 17 may also be utilized to define the extended position of the unit 7 on the housing section 3. It is obvious that, in principle, it is also possible to define another, not fully extended, position of the unit 7 on the housing section 3 by means of a separate latching device. The slid-in position of the unit 7 in the housing section 3 is represented in FIGS. 11 and 12, which position is defined by stop 28 which is adapted to engage with the unit 7. If desired, a separate latching device may be provided for such position of the unit 7, or the end of the opening 8 which extends transversely of the sliding direction may serve as a stop for the unit 7. Moreover, a further position between the two extreme positions of the unit 7 may be defined by a separate latching device.

Removing the unit 7 from the housing section 3 is also possible without additional aids. For this purpose the unit 7 is moved into its position in which it projects from the housing section 3, as shown in FIGS. 9 and 10. Subsequently, the strip 20 on the unit 7 is depressed with one finger and the unit is then slid further in the sliding direction 9 towards the bridge 17, so that the strip 20 is again located underneath the bridge 17. This movement of the unit 7 is continued until the ends 22 and 23 of the guide portions 10 and 11 respectively on the unit 7 have left the respective guides 12 and 13 on the housing section 3, whereafter the unit 7 is tilted clockwise inside the opening 8 in the housing section 3 and can be removed from this housing section. The unit 7 is then tilted almost automatically, because the strip 20 urges the unit 7 away from the bridge 17 as a result of its resilience.

As can be seen, neither mounting nor removal of the unit 7 from the housing section 3 requires the use of separate aids, so that these operations are simple and time-saving, which is of special importance for mass production. Inadvertent removal of the unit 7 from the housing section 3 is simply precluded by the steps described in the foregoing.

It is obvious that a number of modifications to the embodiment described in the foregoing are possible without departing from the scope of the invention. This is particularly so for the construction of the guide portions on the unit and the guides on the housing section. In this respect it is to be noted that, as an alternative, two parallel adjacent strips may be arranged on the unit 7 to provide an even greater protection against inadvertent removal of the unit from the housing section. Neither is it necessary that the bridge 17 completely bridges the opening 8, but it may extend only into the path of the free end 21 of the strip 20. Furthermore, it is possible to reverse the location of the bridge and the guides on the housing section relative to the ends of the opening 8 in the housing section.

What is claimed is:

1. A dry-shaving apparatus which comprises a housing section having an opening formed therein; a trimmer constructed as a flat unit and arranged on said housing section so as to be slidable between at least two positions, the trimmer unit being mounted in said opening; two lateral guide portions formed on the trimmer unit and extending parallel to each other and to the sliding direction of the trimmer unit; guides formed on the housing section and respectively co-operating with said guide portions, said guides, viewed in the sliding direction, being arranged near one end of the opening; a bridge arranged near the other end of the opening and extending across said opening transversely of the sliding direction, said bridge engaging the trimmer unit from the inside of the housing section; and a resilient strip extending from the trimmer unit in the sliding direction and projecting into the interior of the housing section towards the bridge, the normal distance, measured in the sliding direction, between the free end of the strip and those ends of the guide portions remote from said free end of the strip being greater than the clearance between the bridge and those ends of the guides facing said bridge.

2. A dry-shaving apparatus according to claim 4, in which the guide portions comprise projecting ridges extending adjacent the opening along the inner wall of the housing section, and the guides comprise hook-shaped projections projecting from the housing section and engaging the ridges from the inside of the housing section.

3. A dry-shaving apparatus according to claim 2, in which the bridge includes lateral basic portions extending adjacent the opening up the inner wall of the housing section, and the clearance between the bridge and those ends of the projections on the housing section facing said bridge is greater than the length of the ridges on the trimmer unit.

* * * * *

UNITED STATES PATENT AND TRADEMARK OFFICE

CERTIFICATE OF CORRECTION

PATENT NO. : 4,434,553

DATED : March 6, 1984

INVENTOR(S) : Werner Kness

It is certified that error appears in the above-identified patent and that said Letters Patent is hereby corrected as shown below:

Column 6, line 54, change"claim 4," to --claim 1,--.

Signed and Sealed this

*Twenty-second* Day of *May 1984*

[SEAL]

*Attest:*

GERALD J. MOSSINGHOFF

*Attesting Officer*

*Commissioner of Patents and Trademarks*